US008573399B2

(12) United States Patent
Ulmer et al.

(10) Patent No.: US 8,573,399 B2
(45) Date of Patent: Nov. 5, 2013

(54) MATERIAL HANDLING DEVICE

(75) Inventors: John Ulmer, Ottawa (CA); Hongqiao Li, Edmonton (CA); Kevin McTavish, Edmonton (CA)

(73) Assignee: Canada Post Corporation, Ottawa, Ontario (CA)

( * ) Notice: Subject to any disclaimer, the term of this patent is extended or adjusted under 35 U.S.C. 154(b) by 32 days.

(21) Appl. No.: 13/175,085

(22) Filed: Jul. 1, 2011

(65) Prior Publication Data

US 2012/0273381 A1 Nov. 1, 2012

(51) Int. Cl.

| | |
|---|---|
| ***B65D 21/00*** | (2006.01) |
| ***B65D 21/02*** | (2006.01) |
| ***B65D 85/62*** | (2006.01) |
| ***B65D 45/16*** | (2006.01) |

(52) U.S. Cl.

USPC ..... 206/506; 206/503; 206/505; 206/508; 220/4.26; 220/4.27; 220/324

(58) Field of Classification Search

USPC ..... 220/4.26, 4.27, 23.2, 23.6, 324; 206/503, 504, 505, 506, 508

See application file for complete search history.

(56) References Cited

U.S. PATENT DOCUMENTS

| | | | | |
|---|---|---|---|---|
| 2,029,746 | A | 2/1936 | Tufts et al. | |
| 2,641,383 | A | 6/1953 | Coursey | |
| 3,375,953 | A | 4/1968 | Miller, Jr. | |
| 3,379,339 | A | 4/1968 | Asenbauer | |
| 3,752,352 | A | 8/1973 | Senecal | |
| 4,105,117 | A | 8/1978 | Atkin et al. | |
| 4,109,791 | A | 8/1978 | Clipson et al. | |
| 4,391,369 | A | 7/1983 | Stahl et al. | |
| 4,573,577 | A | 3/1986 | Miller | |
| 4,848,578 | A | 7/1989 | Schafer | |
| 4,905,833 | A | 3/1990 | Kreeger et al. | |
| 5,100,015 | A * | 3/1992 | Vanderstuyf | 220/326 |
| 5,494,163 | A | 2/1996 | Apps | |
| 5,538,154 | A | 7/1996 | Von Holdt | |
| 5,609,254 | A | 3/1997 | Loftus et al. | |
| 5,979,691 | A | 11/1999 | Von Holdt | |
| 6,220,637 | B1 * | 4/2001 | Kierl | 292/87 |
| 6,253,952 | B1 | 7/2001 | Vial | |
| 6,938,772 | B2 | 9/2005 | Aiken et al. | |
| 7,014,043 | B2 | 3/2006 | Raghunathan et al. | |

(Continued)

FOREIGN PATENT DOCUMENTS

| | | | |
|---|---|---|---|
| CA | 2238503 | A1 | 5/1998 |
| CA | 2331202 | A1 | 7/2002 |

(Continued)

*Primary Examiner* — Anthony Stashick
*Assistant Examiner* — Madison L Poos
(74) *Attorney, Agent, or Firm* — Pepper Hamilton LLP

(57) ABSTRACT

A material handling device includes a base, a side, a support member, and a resilient biasing member. The side extends from the base and defines a device interior with the base. The support member is disposed within the device interior proximate the side. The support member includes a cam and is rotatable between a material handling device stacking position and a material handling device nesting position. The biasing member is coupled to the side and is configured to engage the cam and thereby urge the support member into one of the stacking and nesting positions. The resilient biasing member is also configured to effect a translation of the support member towards the side as the support member rotates from a position intermediate the stacking and nesting positions to the one of the stacking position and nesting positions.

18 Claims, 10 Drawing Sheets

(56) References Cited

U.S. PATENT DOCUMENTS

| | | | |
|---|---|---|---|
| 7,017,745 | B2 | 3/2006 | Raghunathan |
| 7,234,599 | B2 | 6/2007 | Hassell et al. |
| 7,464,817 | B2 | 12/2008 | Raghunathan et al. |
| 7,549,554 | B2 | 6/2009 | Hassell et al. |
| 7,581,641 | B2 | 9/2009 | Hassell et al. |
| 7,669,713 | B2 | 3/2010 | Stahl |
| 7,784,615 | B2 | 8/2010 | Stahl |
| 2002/0179480 | A1 | 12/2002 | Raghunathan et al. |
| 2005/0224385 | A1 | 10/2005 | Hassell et al. |
| 2005/0263423 | A1 | 12/2005 | Hassell et al. |
| 2006/0065567 | A1 | 3/2006 | Hassell et al. |
| 2007/0246393 | A1 | 10/2007 | Hassell et al. |
| 2008/0283527 | A1 | 11/2008 | Allen |
| 2010/0147851 | A1 | 6/2010 | Blumenschein |

FOREIGN PATENT DOCUMENTS

| | | | |
|---|---|---|---|
| CA | 2367649 | A1 | 7/2002 |
| CA | 2431444 | A1 | 9/2004 |
| CA | 2578840 | A1 | 4/2006 |
| CA | 2539678 | A1 | 10/2006 |
| DE | 202007003595 | U1 | 5/2007 |
| GB | 2086862 | A | 5/1982 |

* cited by examiner

MATERIAL HANDLING DEVICE

FIELD

This patent application relates to a material handling device configured for stacking or nesting with other material handling devices of like construction. In particular, this patent application relates to a material handling device comprising support members movable between stacking and nesting positions.

BACKGROUND

A material handling device may be used for transporting, sorting, or storing goods of various sizes and properties. It is a desirable feature of material handling devices that the devices are stackable to protect the devices' contents. It is also desirable that the material handling devices are nestable within one another when the material handling devices are empty.

Kreeger et al. (U.S. Pat. No. 4,905,833) describes a nestable and stackable container having a rotatable stacking shelf mounted to the container side walls. The side walls each include an interior portion having a horizontal shoulder at the upper edge thereof, and an exterior portion having an inwardly-facing rounded pivot portion. Each shelf includes backward J-shaped portions that are disposed between the interior and exterior side wall portions, and pivot about the pivot portions to allow the stacking shelfs to rotate between stacking and nesting positions. The horizontal shoulders compress somewhat as the stacking shelfs rotate, to thereby provide a maximum resistance against rotation intermediate the stacking and nesting positions. When the stacking shelfs are pivoted to the stacking position, the stacking shelfs can support the bottom of a container of like construction when stacked.

SUMMARY

As described in this patent application, the material handling device comprises a base, a side extending from the base such that the base and the side define a device interior, a support member being rotatable between a device stacking position and a device nesting position, and a resilient biasing member coupled to the side configured to urge the support member into one of the stacking and nesting positions. The support member may include a cam and the resilient biasing member may be configured to engage the cam and thereby urge the support member into one of the stacking and nesting positions. The resilient biasing member may be further configured to effect a translation of the support member towards the side as the support member rotates from a position intermediate the stacking and nesting positions to the one of the stacking and nesting positions.

In accordance with another aspect of the present invention, there is provided a material handling device lid comprising a lid top and a resilient latch coupled to the lid top. The lid top includes an upper surface, a lower surface, a latch opening extending between the upper and lower surfaces, and a flange coupled to the lower surface. The resilient latch is configured as a V-spring and comprising a first arm and a second arm. The first arm is coupled to the lid top and extends below the lid top away from the lower surface. The second arm is coupled to the first arm and extends towards the lid top and the lower surface. The second arm may include at least one tang disposed proximate the flange and below the lower surface.

In accordance with another aspect of the present invention, there is provided a material handling device assembly comprising: a material handling device comprising: a base; a side extending from the base, the base and the side defining a device interior; a support member disposed within the device interior proximate the side, the support member including a cam and being rotatable between a device stacking position and a device nesting position; and a resilient biasing member coupled to the side and being configured to engage the cam and thereby urge the support member into one of the stacking and nesting positions, the resilient biasing member being further configured to effect a translation of the support member towards the side as the support member rotates from a position intermediate the stacking and nesting positions to the one of the stacking position and nesting positions; and a device lid configured to enclose the device interior, the device lid comprising: a lid top including an upper surface, a lower surface, a latch opening extending between the upper and lower surfaces, and a flange coupled to the lower surface; and a resilient latch coupled to the lid top, the resilient latch being configured as a V-spring and comprising a first arm and a second arm, the first arm being coupled to the lid top and extending below the lid top away from the lower surface, and a second arm coupled to the first arm and extending towards the lid top and the lower surface, the second arm including at least one tang disposed proximate the flange and below the lower surface.

BRIEF DESCRIPTION OF THE DRAWINGS

The aforementioned features will now be described, by way of example, with reference to the accompanying drawings, in which.

DETAILED DESCRIPTION

Figure 6:
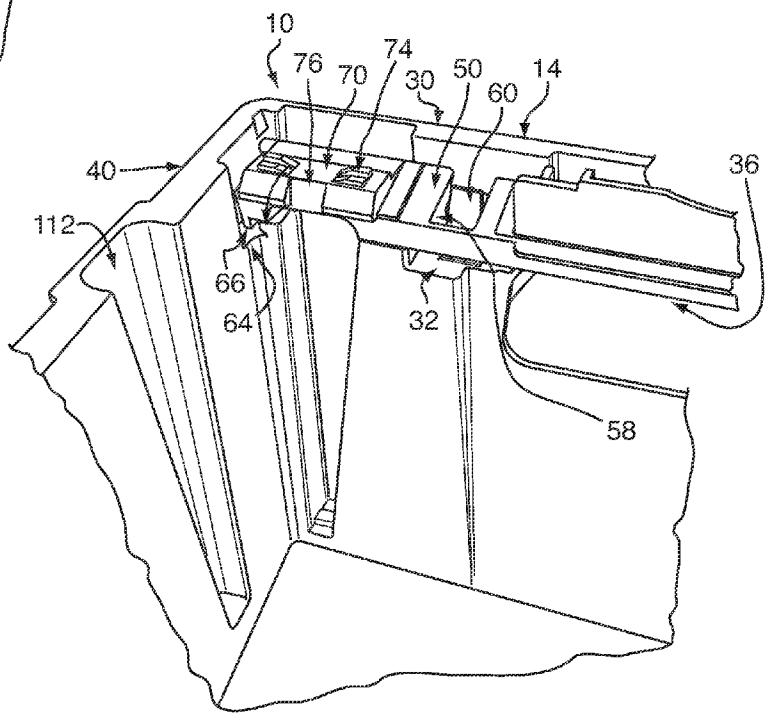
FIG. 6 is a partial interior perspective view of the material handling device showing the support member of FIG. 5 in the stacking position.
Figure 5:
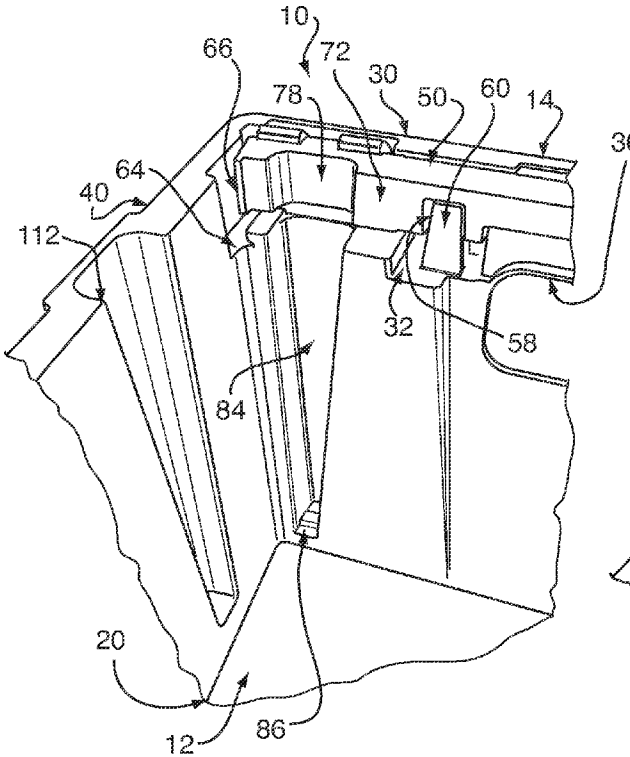
FIG. 5 is a partial interior perspective view of the material handling device showing a support member in the nesting position.

The drawings depict a material handling device, denoted generally as 10, that comprises a base 20, a side 14 extending from the base 20 such that the base 20 and the side 14 define a device interior 12, a support member 50 being rotatable between a device stacking position and a device nesting position, and a resilient biasing member 60 coupled to the side 14 configured to urge the support member 50 into one of the stacking and nesting positions. The support member 50 may include a cam 52 and the resilient biasing member 60 may be configured to engage the cam 52 and thereby urge the support member 50 into one of the stacking and nesting positions. The resilient biasing member 60 may be further configured to effect a translation of the support member 50 towards the side 14 as the support member 50 rotates from a position intermediate the stacking and nesting positions to the one of the stacking and nesting positions. FIG. 5 shows an implementation of the material handling device 10 with the support member 50 in the nesting position and FIG. 6 shows an implementation of the material handling device 10 with the support member 50 in the stacking position. While the implementations shown may be preferable, other variations of shape and configuration of material handling device 10 are possible without departing from the scope of the invention. The side 14 may comprise a pair of opposed end walls 30 and a pair of side walls 40. Walls 30 and 40 may be of unitary construction integrally formed with the base 20. Each of the end walls 30 may be substantially parallel with one another or the end walls may be disposed at various angles with respect to the base 20 in order to form the device interior 12. Likewise, side walls 40 may be substantially parallel with one another or disposed at various angles with respect to the base 20 in order to form the device interior 12.

As shown in FIGS. 5 and 6, biasing members 60 may be optionally attached to shoulder surfaces 32, of side 14. Shoulder surface 32 may be formed on an interior portion of side 14, distal from the base 20. Alternatively, biasing member 60 may extend inwardly from end walls 30. Furthermore, the biasing members 60 may alternatively be attached to the side walls 40, extending inwardly therefrom to engage hook members 62 attached to the support member 50 proximate the side walls 40. While the figures depict an implementation of material handling device 10 comprising two biasing members 60 attached to each shoulder surface 32, the quantity and distribution of biasing members 60 is not intended to be limiting. Material handling device 10 may optionally comprise only one biasing member 60 per shoulder surface 32, or a plurality of biasing members 60 attached to shoulder surfaces 32, end walls 30, or side walls 40 of side 14. In particular, the material handling device 10 may include a pair of biasing members 60 where each biasing member is optionally attached to a respective one of the shoulder surfaces 32.

Each resilient biasing member 60 may have a neutral position and a deformed position displaced from the neutral position. The cam 52 of support member 50 may include a cam surface 53, shown in FIGS. 9 and 10, configured to direct the biasing member 60 from the neutral position towards the deformed position upon the rotation of the support member 50 between one of the stacking and nesting positions and the intermediate rotational position. In one implementation, as the support member 50 is rotated, cam 52 may rotate with support member 50 causing cam surface 53 to press against biasing member 60 causing biasing member 60 to bend away from support member 50. The biasing member 60 may be configured to urge the support member 50 from the intermediate rotational position into the one of the stacking and nesting positions as the biasing member returns to the neutral position from the deformed position.

Figure 8:
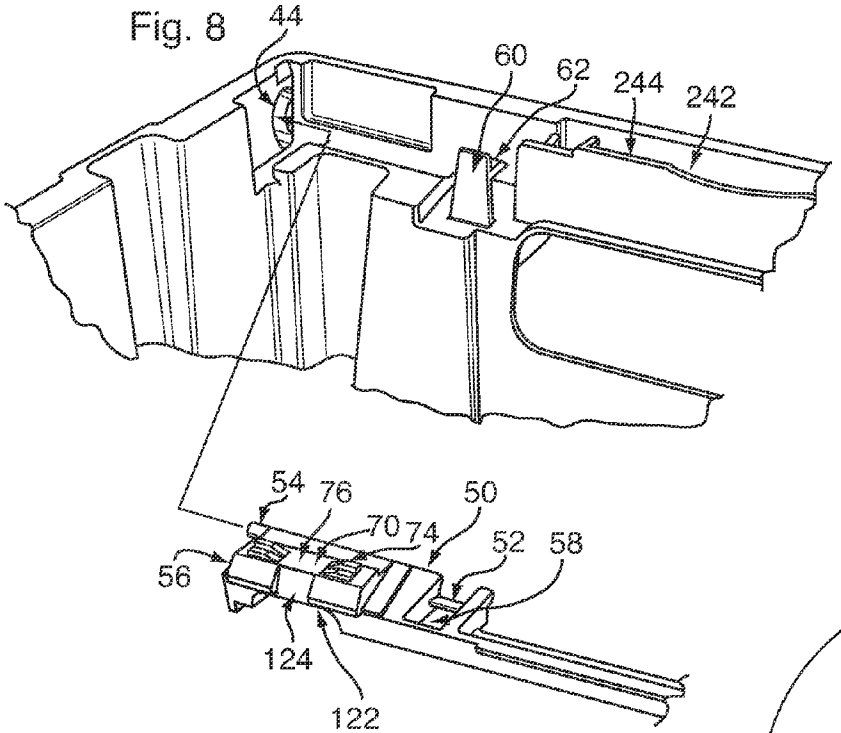
FIG. 8 is a partial interior perspective view of the material handling device showing the material handling device with the support member of FIG. 5 removed.

Each resilient biasing member 60 may include a hook member 62 that is configured to engage the cam surface 53 and thereby maintain the support member 50 within the device interior 12 as the support member 50 rotates between the stacking position and the nesting position. As shown in FIG. 8, cam 52 may be shaped as an elongate bar configured to engage the hook member 62. The hook member 62 of each biasing member 60 may be oriented toward the base 20, away from the base 20, or in any other interior direction provided that the hook member 62 is able to engage the cam 52 of the support member 50.

Figure 9:
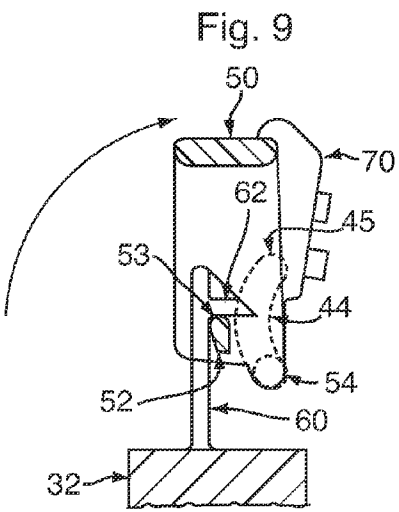
FIG. 9 is a partial side elevation view of the support member of FIG. 5 and the biasing member of the material handling device of FIG. 8 showing the support member in the nesting position.
Figure 10:
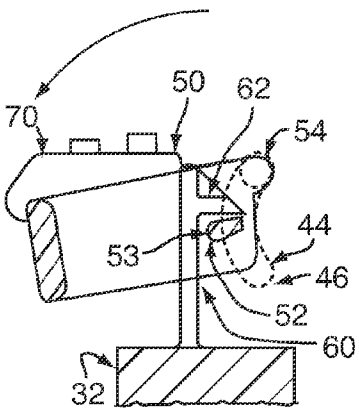
FIG. 10 is a partial side elevation view of the support member of FIG. 5 and the biasing member of the material handling device of FIG. 8 showing the support member in the stacking position.

FIGS. 9 and 10 show details of an implementation of support member 50 and resilient biasing member 60 when the support member 50 is in a nesting position and stacking position, respectively. In order to retain the support member 50 in either the stacking position or the nesting position, the hook member 62 may resist movement of the cam 52 by contacting the cam 52 during rotation of the support member 50. Where the weight of the support member 50 alone exerted upon the hook member 62 is insufficient to cause enough deformation of the resilient biasing member 60 to allow the support member 50 to move between stacking and nesting positions, an additional force may be applied by a user to the support member to cause sufficient deformation of resilient biasing member 60 thereby allowing the support member 50 to move between stacking and nesting positions. Upon removal of the user-applied force, the resilient biasing member 60 may return to an equilibrium position urging the support member 50 into one of the stacking and nesting positions and retaining the support member 50 in that respective position. Even though it is described that the support member 50 may be retained by the resilient biasing member 60, it is understood that some movement of support member 50 may be possible while being retained by the resilient biasing member 60 without transitioning between stacking and nesting positions.

Figure 4:
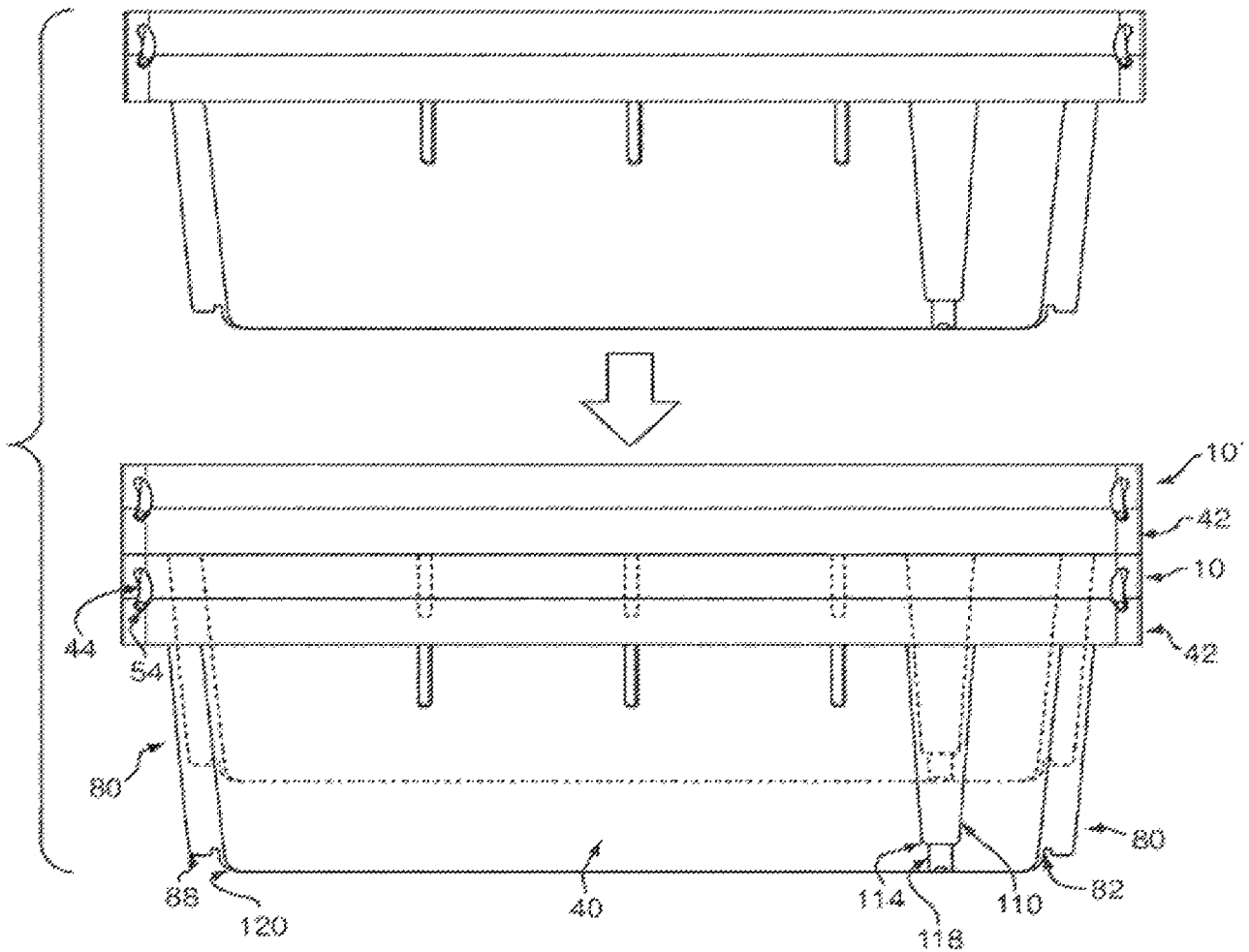
FIG. 4 is a side elevation view of three material handling devices shown in a nesting arrangement and transitioning to a nesting arrangement.
Figure 14:
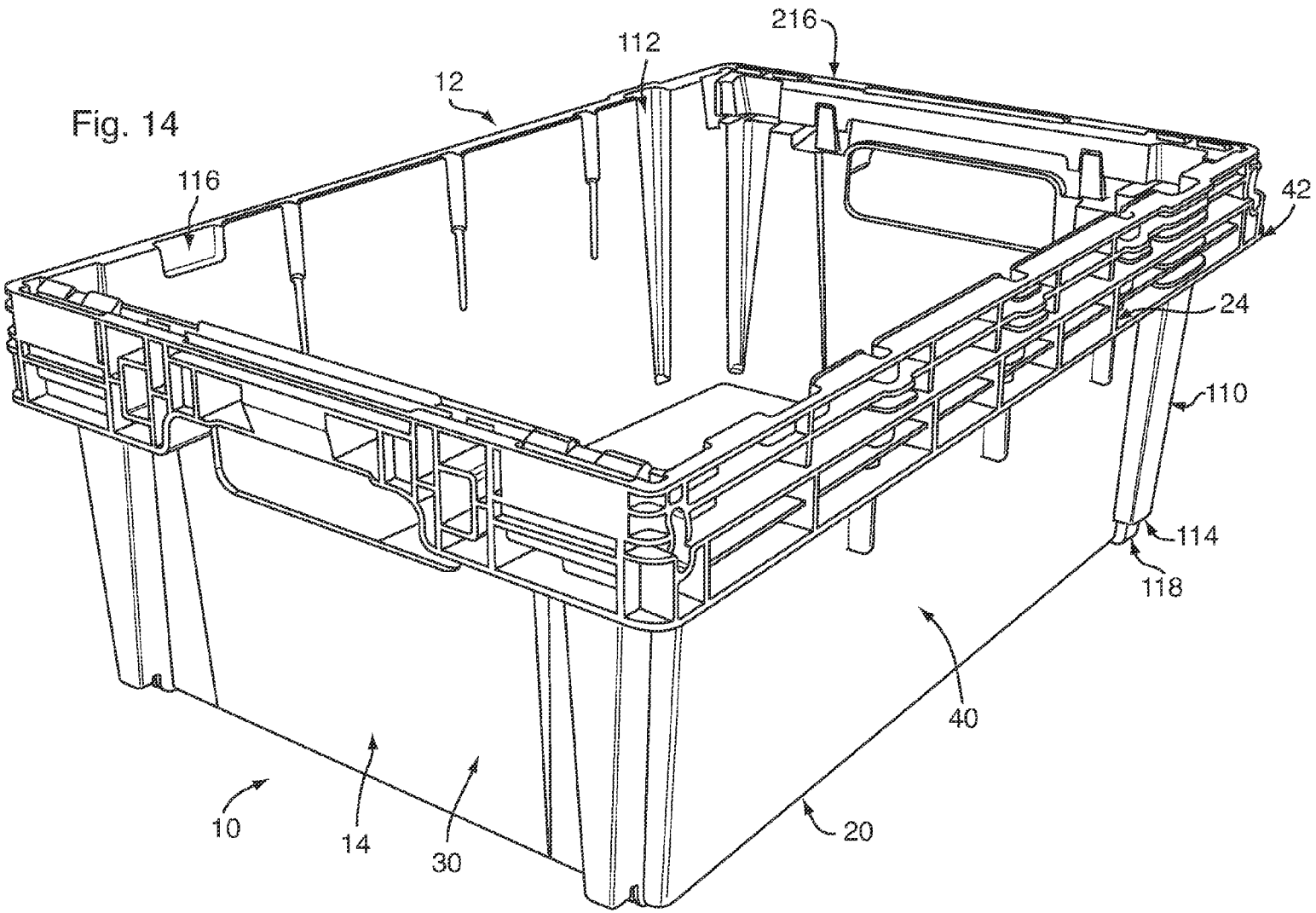
FIG. 14 is an exterior perspective view of an implementation of the material handling device.

Optionally, a flanged nesting support surface 42 may be provided formed in exterior portions of side 14, including in end walls 30 and side walls 40. As shown in FIG. 4, when one material handling device 10' is nested within another material handling device 10, the nesting support surface 42 of material handling device 10' may rest upon the nesting support surface 42 of material handling device 10. The flanged nesting support surface 42 may circumscribe the entirety of each material handling device 10. While the flanged nesting support surface 42 is shown as being formed in end walls 30 and side walls 40 distal from the base, the flanged nesting support surface 42 may be disposed at any distance from the base. To allow for efficient nesting of material handling devices 10 and 10' it is preferable that the level of the flanged nesting support surface 42 be consistent between material handling devices 10 and 10' intended to be nested together. Flanged surface 42 may be formed of a continuous dense material, or flanged surface may have hollow interior regions. Optionally, flanged surface 42 may feature one or more strengthening ribs 24 formed therein, as shown in FIG. 14. These ribs may extend in any direction, but may preferably extend laterally or longitudinally throughout flanged surface 42 which may provide support for forces exerted upon the material handling device 10 by items contained in material handling device 10 or by material handling devices stacked or nested therein. The shape of ribs 24 may be partially defined by exterior or interior structural shapes of material handling device 10. For example, ribs 24 formed on a surfacing protruding out of material handling device 10 may protrude an additional amount. Ribs 24 may also provide outlines for any apertures formed in or extending through the flanged surface 42. Since each support member 50 may remain closely retained proximate to end wall 30, a nesting of material handling devices 10 with about a 3.3 to 1 ratio, 4 to 1 ratio, or less may be achieved.

The side 14 of material handling device 10 may further comprise a guide channel 44. The support member 50 may further comprise a guide pin 54 extending axially from an end thereof into the guide channel 44 for sliding engagement therewith. The guide channel 44 may be configured to facilitate the translation of the support member 50 towards the side 14 as the support member 50 rotates from the intermediate rotational position towards one of the stacking and nesting positions. There may be guide channels 44 formed in opposing portions of side 14, such that each guide channel 44 may be positioned proximate an end wall 30 to receive a corresponding guide pin 54 extending axially from each end of support member 50, as shown in FIG. 8. The guide channels 44 may be proximate each of the shoulder surfaces 32. While support channels 44 may not necessarily serve to resist support members 50 from moving between stacking and nesting positions, the support channels 44 may nevertheless aid in guiding the support members 50 between positions.

The guide channel 44 may be further configured to direct the guide pin 54 towards the base 20 and thereby maintain the support member 50 within the device interior 12 as the support member 50 rotates between the stacking and nesting positions. FIG. 9 shows a particular implementation of support member 50 in a nesting position whereby the guide pin 54 is inserted into guide channel 44. Optionally, as shown in FIG. 9, each guide channel 44 may be substantially arcuate shaped comprising a first end 45 and a second end 46, the first end 45 being disposed above the second end 46. The guide pin 54 may therefore be disposed to engage the first end 45 of the guide channel 44 when the support member 50 is in the stacking position and to engage the second end 46 when the support member 50 is in the nesting position. Even though guide pin 54 is shown as being located at a lateral edge of the guide channel 44 to engage with second end 46, guide pin 54 may extend longitudinally from any location on support member ends 56. FIG. 10 shows a similar implementation as FIG. 9 with support member 50 in a stacking position. In this position, guide pin 54 may contact first end 45 of guide channel 44.

Figure 2:
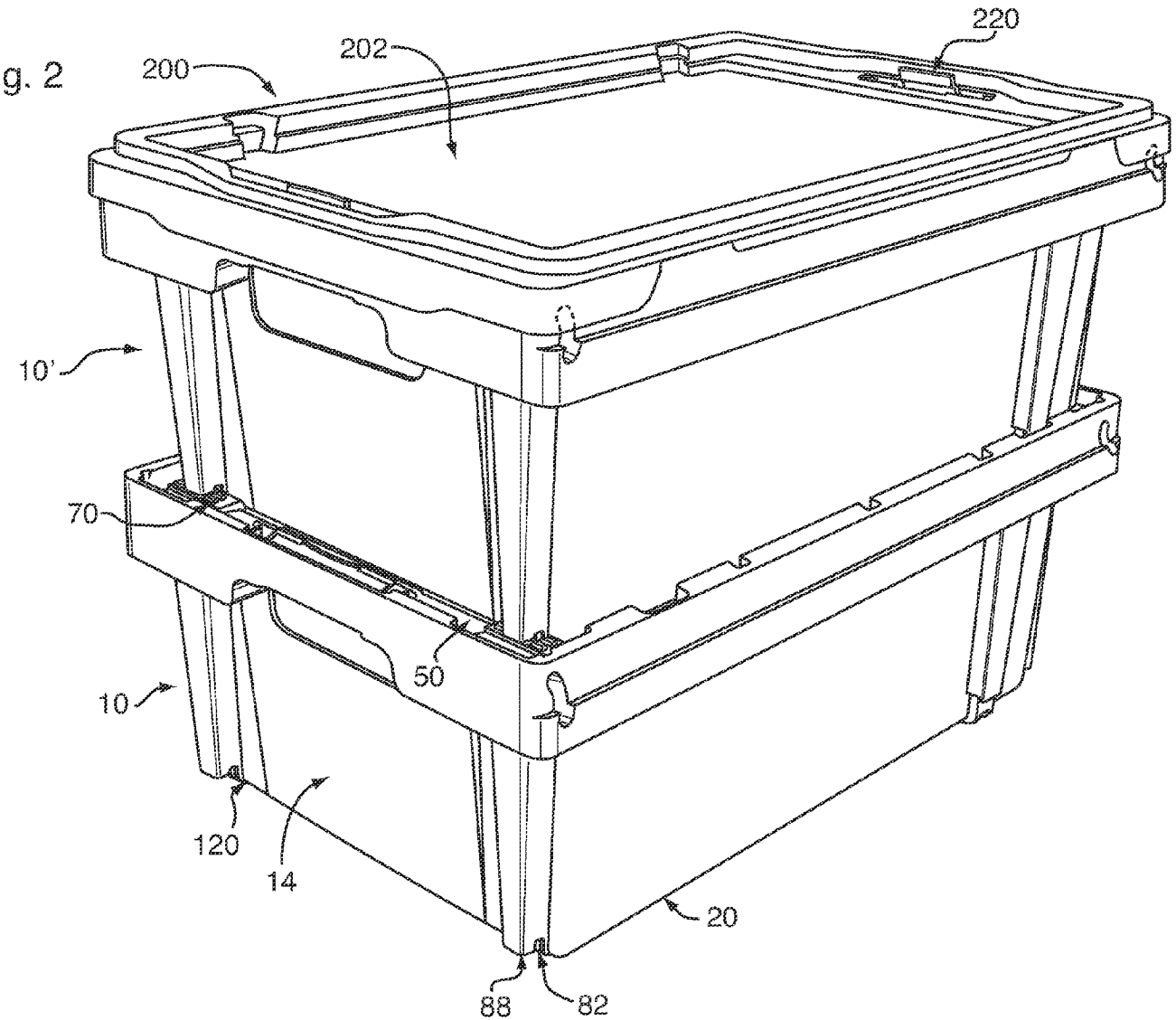
FIG. 2 is an exterior perspective view of two material handling devices with lids shown in a stacking arrangement.
Figure 3:
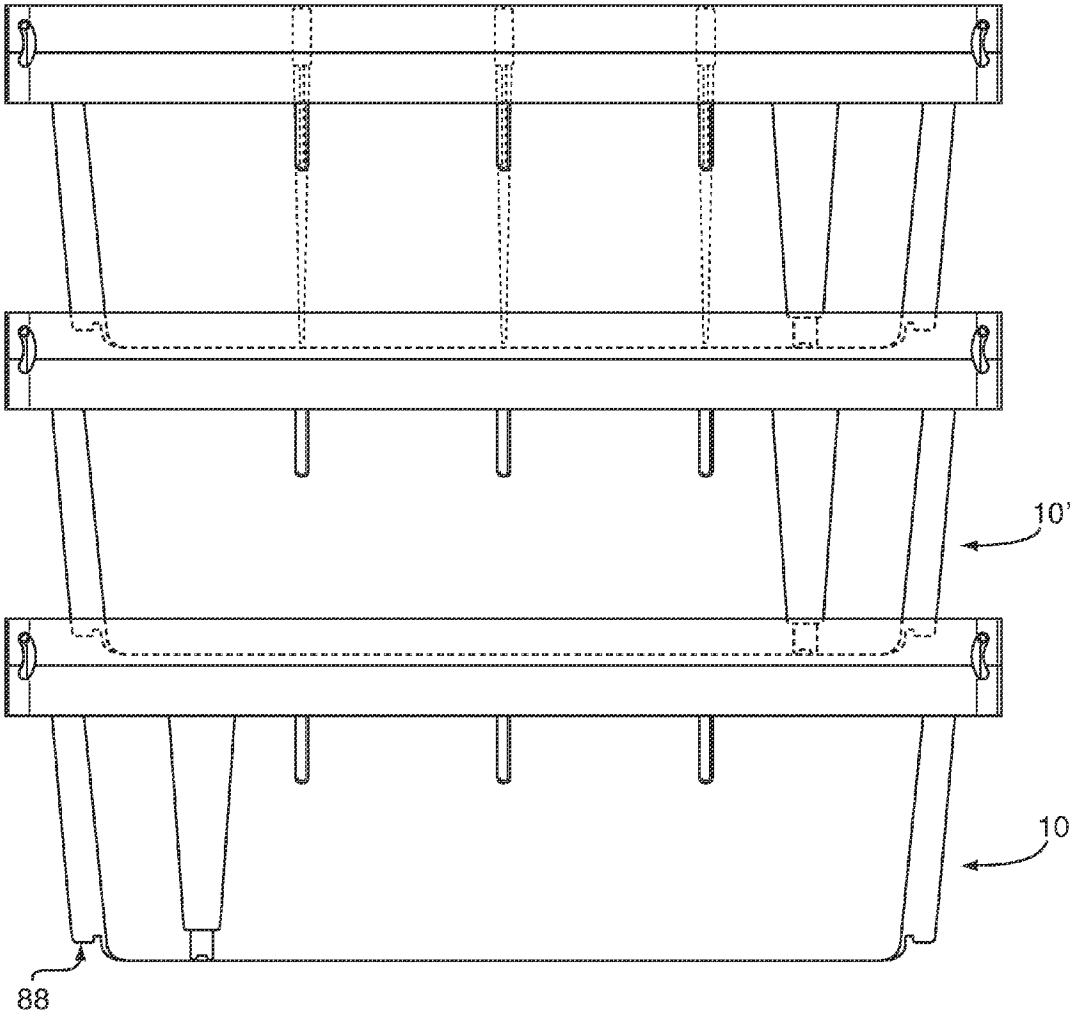
FIG. 3 is a side elevation view of three material handling devices shown in a stacking arrangement.

The support member 50 may further comprise a stacking platform that includes a pair of ribs 74 configured to capture therebetween a foot portion 88 of a material handling device 10' stacked on material handling device 10 to thereby limit lateral movement of the material handling device 10' relative to the material handling device 10 when the support member 50 is in the stacking position. FIG. 2 shows an implementation of material handling device 10 where a material handling device 10' is stacked upon a material handling device 10 of like construction. In this implementation, support member 50 of material handling device 10 is shown with two stacking platforms 70 upon which first material handling device 10' is supported. While only two stacking platforms 70 are shown per support member 50, each support member 50 may comprise more than two or less than two stacking platforms 70. An implementation of stacking platforms 70 are shown in more detail in FIG. 6. Optionally, stacking platforms 70 may be substantially parallel or slightly offset from parallel with respect to the base 20 when the support member 50 is in the stacking position, and, as shown in FIG. 5 stacking platforms 70 may be substantially parallel or slightly offset from parallel with respect to end wall 30 when the support member 50 is in the nesting position. Each support member 50 may further include an underside support surface 72 configured to rest upon and be supported by shoulder surface 32 when the support member 50 is in the stacking position. FIG. 3 also shows an implementation of stacked material handling devices 10 and 10' showing that stacking may also be possible where material handling devices 10 and 10' are rotated 180 degrees with respect to one another.

In one implementation, at least one of the end walls 30 may comprise at least one handle aperture 36 formed therein. Preferably, each resilient biasing member 60 is located between a handle aperture 36 and a stacking platform 70 as shown in FIG. 6. Alternatively, handle apertures 36 may be formed into side walls 40 in addition to or in place of any handle apertures 36 formed elsewhere in material handling device 10.

Stacking platform 70 may further include a stabilization channel section 124 for capturing therein an outwardly-extending rib 80 of the stacked material handling device 10' to further limit lateral movement of the stacked material handling device 10' relative to the material handling device 10 when the support member 50 is in the stacking position. The stacking platform 70 may further include at least one stacking platform bumper 122 positioned to support a portion of the material handling device 10'. Each material handling device 10 may include more than one outwardly-extending rib 80 formed in each exterior end wall. As shown in FIG. 2, each outwardly-extending rib 80 may be tapered towards base 20. Optionally, each outwardly-extending rib 80 may be offset from the base 20. Each outwardly-extending rib 80 may also comprise a notch 82 formed into an underside surface of the outwardly-extending rib 80. Each outwardly-extending rib 80 may be configured to rest upon a stacking platform 70 as shown in FIG. 2 when the support members 50 of material handling device 10 are in the stacking position. Preferably, as shown in FIG. 6, stacking platform 70 further comprises longitudinally-spaced upwardly protruding ribs 74 forming a platform channel 76 for receiving the respective outwardly-extending rib 80. Portions of the ribs 74 nearer to channel 76 may slope towards stacking platform 70 in order to allow outwardly-extending rib 80 to be guided towards platform channel 76 for stacking. While only two ribs 74 are shown on either side of platform channel 76, either less than two or more than two ribs 74 may be present. Each stacking platform 70 may further comprise at least one stacking platform bumper 122 forming a stacking platform stabilization channel 124, shown in FIG. 6. Optionally, each outwardly-extending rib 80 may further comprise a stabilization surface 120 located between the base 20 and the notch 82. Surface 120 may protrude outwards from end wall 30 by a lesser width than the portion of outwardly-extending rib 80 near the notch 82. When stacked, surface 120 may rest in-between bumpers 122 within stabilization channel 124. Movement of stacked material handling device 10' towards end walls 30 of material handling device 10 may then be resisted by surface 120 pressing against channel 124.

Stacking platform 70 may further include a nesting channel section 78 for capturing therein an outwardly-extending rib of a material handling device 10' nested in the material handling device 10. The nesting channel section 78 may then serve to limit lateral movement of the nested material handling device 10' relative to the material handling device 10 when the support member 50 is in the nesting position. The nesting channel section 78 may be formed into an underside surface 72 of support member 50. Optionally, side 14 further comprises a nesting channel 84 formed in an interior surface thereof, the nesting channel being substantially continuous with the nesting channel section 78 when the support member 50 is in the nesting position and is configured to capture the outwardly-extending rib 80 therein. There may be more than one nesting channel 84 formed in each end wall 30 and each side wall 40 of side 14. As shown in FIG. 5, each nesting channel 84 may be tapered towards base 20. Each nesting channel 84 may be further offset from base 20 by an offset distance corresponding to the distance by which outwardly-extending rib 80 is offset from the base 20. Each nesting channel 84 may extend upwards to the respective shoulder 32. Indented nesting surface 78 may be sized at least as wide as the widest region of the nesting channel 84. As shown in FIG. 4, each nesting channel 84 may be configured to receive one of the outwardly-extending ribs 80 of a material handling device 10 to be nested within. Located at the bottom of each nesting channel 84 may be a guide bump 86 which may be configured to aid in guiding notch 82 of rib 80 of a nested device to a nested position. In one implementation, where the side 14 comprises a shoulder 32 disposed in the device interior 12, the shoulder may support the support member 50 in the stacking position. This may be achieved by the shoulder 32 extending around to either side of nesting channel 84 as shown in FIG. 5 to allow support member 50 to rest upon shoulder 32 at a plurality of locations providing strong support for support member 50 when rotated to a stacking position. As shown in FIGS. 5 and 6, portions of shoulder 32 that directly contact support member 50 in the stacking position may be raised above other portions of shoulder surface 32, thereby creating support member stabilization recesses 64 in shoulder 32 on either side of each nesting channel 84. Support member 50 may further comprise support member stabilization feet 66 which may rest within recesses 64 and abut upright portions of shoulder surface 32 to limit side to side movement of support member 50. While there may be a plurality of nesting channels 84 and nesting channel section 78, preferably there is a correspondingly aligned nesting channel 84 and nesting channel section 78 for each outwardly-extending rib 80 of material handling device 10.

Optionally, there may be one or more outwardly-extending ribs 110 formed in at least one exterior side wall 40 similar to outwardly-extending ribs 80 formed in end wall 30. The outwardly-extending rib 110 may extend from base 20 to an upper edge of side wall 40, and may further be tapered towards base 20. Side wall 40, as shown at least in FIG. 5, may further comprise a nesting channel 112 formed into an interior surface of side wall 40 configured to receive outwardly-extending rib 110 of a material handling device 10' when nesting material handling devices 10. FIG. 4 shows the nesting of material handling device 10' within material handling device 10. The dotted lines indicate the position of the various features of the top material handling device 10' as nested within the bottom material handling device 10. Side wall outwardly-extending rib 110 of material handling device 10' is inserted into side wall nesting channel 112 of material handling device 10. In an implementation where outwardly-extending rib 110 and side wall nesting channel 112 are offset from the centre of side wall 40, or where there is not an additional set of outwardly-extending ribs 110 and channel 112 providing symmetry to side wall 40, then nesting of such material handling devices 10 would only be possible when outwardly-extending rib 110 and channel 112 are aligned. Should material handling device 10' be rotated 180 degrees, outwardly-extending rib 110 would abut against either a top edge of side wall 40, or against a secondary stacking support recess 116 shown in FIG. 14. Preferably, should secondary stacking support recess 116 exist, it may be spaced a distance from end wall 30 corresponding to the distance that side wall nesting channel 112 is spaced from the opposing end wall 30. Side wall outwardly-extending rib 110 may extend outwardly a lesser amount near the base 20 than elsewhere forming a side wall support bumper 118 near the base 20 and a side wall support foot 114 just above the bumper 118, offset from the base 20. The support foot 114 may contact the bottom of side wall nesting channel 112 when nested or secondary stacking support recess 116 when stacked. The bumper 118 may abut against an interior portion of side wall 40 just below the secondary stacking support recess 116 when stacked, or just below side wall interior nesting channel 112 when nested. In these implementations, the bumper may serve to stabilize movement of a stacked or nested material handling device 10 towards side walls 40.

Figure 7:
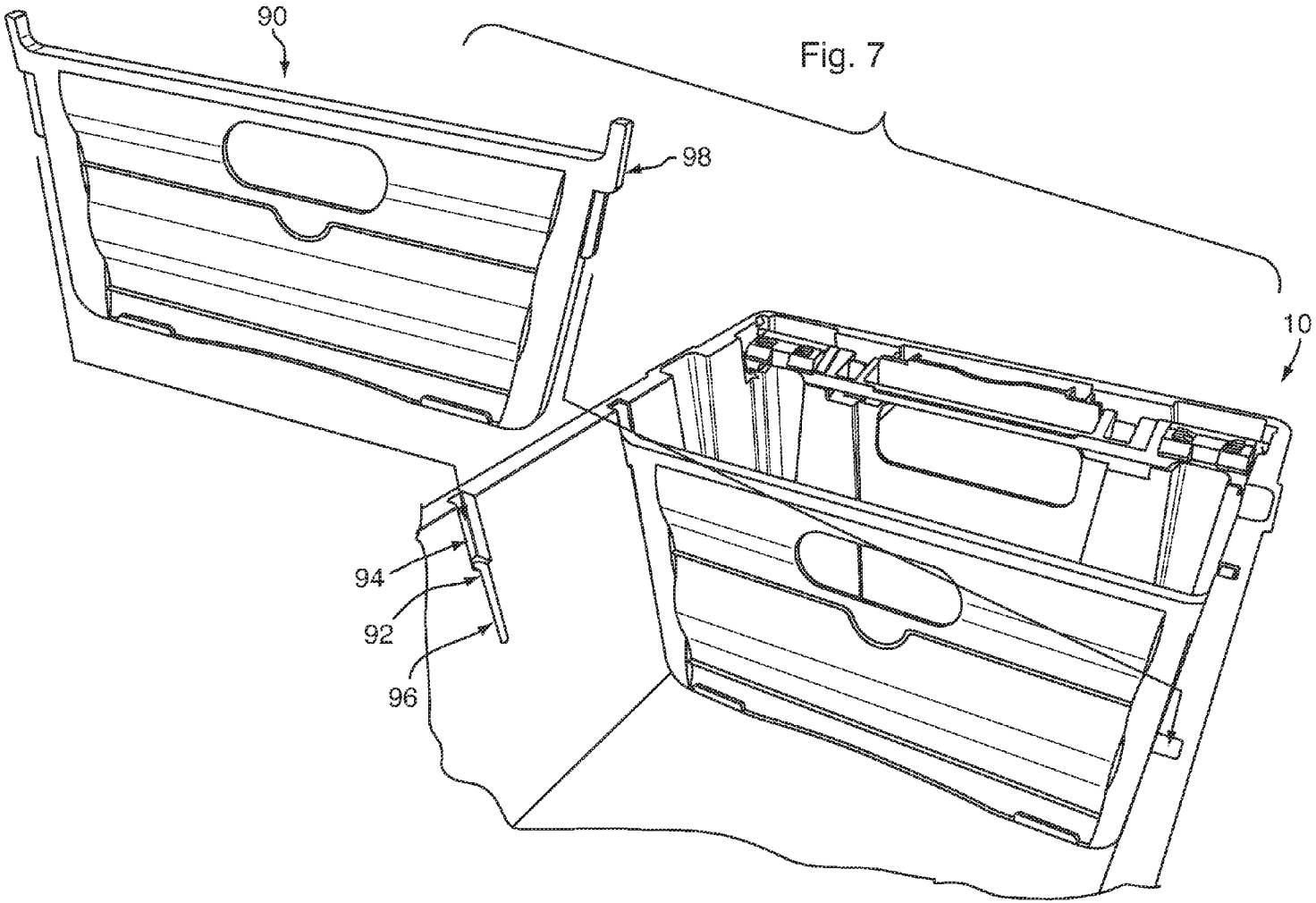
FIG. 7 is a partial interior perspective view of the material handling device showing the support member of FIG. 5 in the stacking position and an internal divider inserted into the material handling device.

The side walls 40 may further comprise at least one pair of opposed divider channels 92. As shown in FIG. 7, each channel 92 is preferably aligned with another channel 92 of like dimensions on the opposing side wall 40. The opposed divider channels 92 may be located anywhere along the side walls 40 and may begin at an upper region of the side walls 40 distal from the base 20. Each divider channel may be sized to receive a removable divider wall 90. Each divider channel may be tapered towards the base. This tapering may be achieved by defining an upper wide portion 94 of the divider channel 92 narrowing to a lower narrow portion 96. Each divider wall 90 may also comprise corresponding divider support grooves 98 sized to fit and be supported by the divider channel 92. The divider channels 92 may be spaced equal distances from one another in side wall 40. Where it is desired to fill material handling device 10 with items that would not fill the material handling device 10 to capacity, it may be desired to insert divider wall 90 into one of the divider walls 90 in order to effectively create a smaller volume within material handling device 10 in which to place the items. In this way, the items may better remain stacked or sorted when the material handling device 10 is moved and not slide about within material handling device 10.

The support member 50 may further comprise a biasing channel 58 formed therein for receiving the biasing member 60 therein, and a portion of the cam 52 may extend across the biasing channel. As shown in FIG. 8, each biasing channel 58 may be configured to fit one of the hook members 62 of the biasing member 60. As shown more clearly in FIGS. 9 and 10, in one implementation, the upper portion of biasing member 60 where the hook member 62 may be located, may be inserted through the biasing channel 58 to engage cam 52. FIGS. 5 and 6 also show an implementation of portions of the biasing member 60 inserted through the biasing channel 58 with the support member 50 in nesting and stacking positions, respectively. Each cam 52 of each support member 50 may be integrally formed therein, extending across the biasing channel 58, as shown in FIG. 8. Beginning from a nesting position as shown in FIG. 9, a rotation of the support member 50, and thus the cam 52, may apply a directional force away from the nearby end wall 30 causing the biasing member 60 to deform away from the nearby end wall 30 until the stacking position is reached. Optionally, each cam 52 may comprise a rounded edge portion that contacts the correspondingly engaged hook member 62. The cam 52 may be configured to contact the hook member 62 at all times, or only when the support member 50 is changing positions. Each biasing member 62 may also be formed substantially orthogonally into the respective shoulder 32, and cam 52 may also be formed into the respective support member 50.

While many structural features of material handling device 10 are described in relation to end walls 30 of side 14 and other features are described in relation side walls 40 of side 14, and while the figures show end walls 30 as being narrower than side walls 40, the dimensions of the walls are not intended to be a limiting feature of material handling device 10. Optionally, end walls 30 could have a greater width than side walls 40. While it is preferable that the height of end walls 30 and side walls 40 be substantially consistent, this is also optional so long as material handling device 10 may still be stackable and nestable upon another material handling device 10 of like construction. While each of the end walls 30, side walls 40, and base 20 are shown as being solid, substantially continuous pieces of material, other configurations of walls may be possible. For example, one or all of end walls 30, side walls 40, and base 20 may comprise cutouts of various shapes, or be constructed out of a resilient plastic, metal, carbon fiber or other material which may form meshed or webbed surfaces. Optionally, each end wall 30 and side wall 40 may be shaped in an arcuate or other manner instead of straight, flat surfaces. The material handling device 10 may be of unitary construction or formed of component parts. Optionally, the entire material handling device 10 may be of unitary construction save for support members 50.

Figure 11:
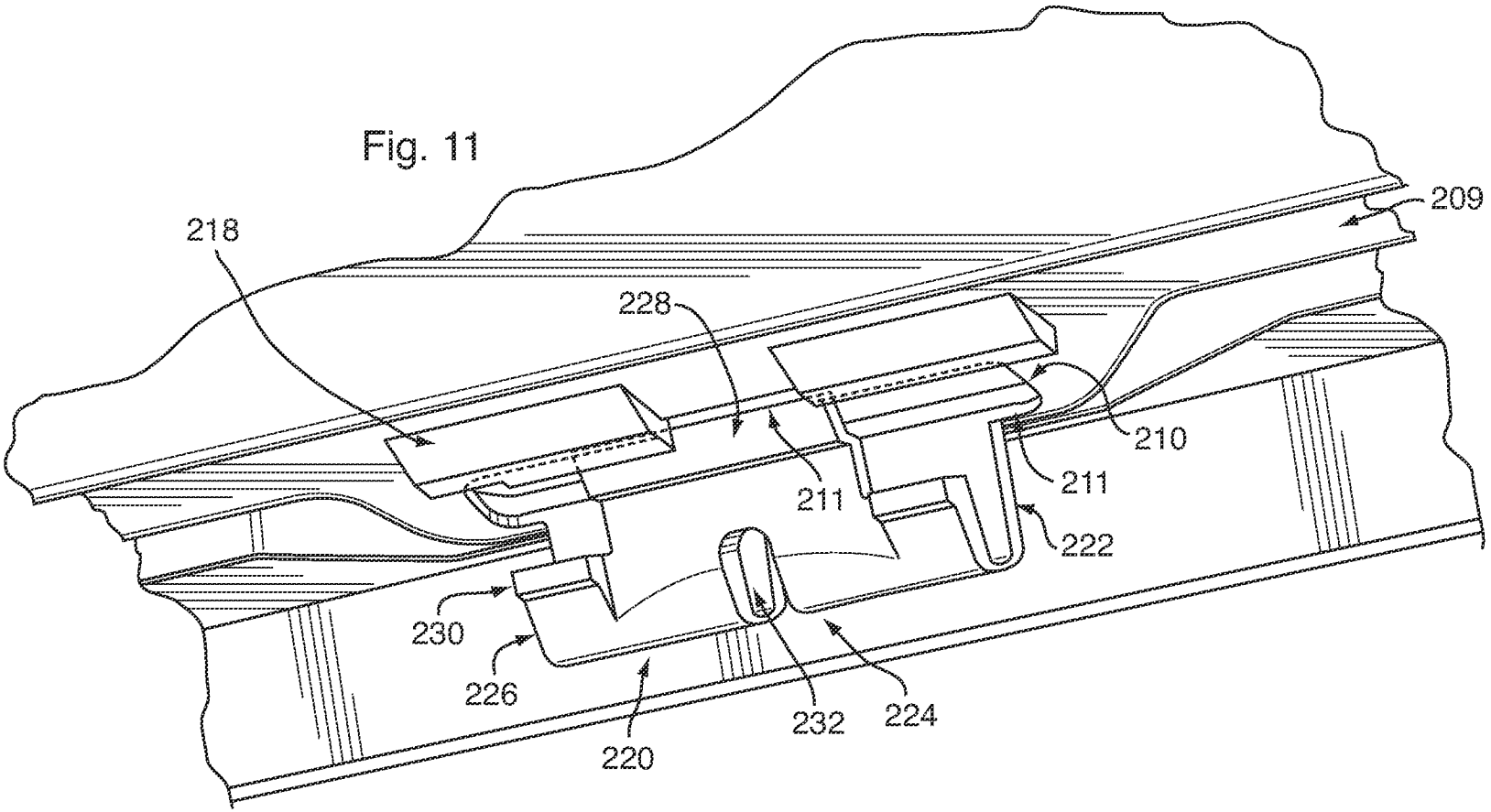
FIG. 11 is a partial bottom perspective view of the lid of FIG. 1 showing the lid latch member.

FIGS. 1, 2, 11, 12, and 13 also depict a material handling device lid, denoted generally as 200, that comprises a lid top 202 and a resilient latch 220 coupled to the lid top 202. The lid top 202 includes an upper surface 208, a lower surface 209, a latch opening 210 extending between the upper 208 and lower 209 surfaces, and a flange 218 coupled to the lower surface 209. The resilient latch 220 is configured as a V-spring and comprises a first arm 222 and a second arm 226. The first arm 222 is coupled to the lid top 202 and extends below the lid top 202 away from the lower surface 209. The second arm 226 is coupled to the first arm 222 and extends towards the lid top 202 and the lower surface 209. The second arm 226 may include at least one tang 230 disposed proximate the flange 218 and below the lower surface 209. As shown in FIG. 11, the first arm 222 may connect along a bent edge 224 to second arm 226 extending towards the latch opening 210. While the bent edge 224 appears integrally formed into resilient latch 220, bent edge 224 may be replaced by a coil spring or any other suitable biasing structure that allows resilient latch 220 to return to and remain in a rest position when no user-applied forces are being exerted upon the resilient latch 220. Further still, while FIG. 11 shows the bent edge 224 as being below the lid top 202 of the material handling device lid 200, an implementation where the bent edge 224 is located above the top surface 202 is also possible. In that implementation, a portion of second arm 226 would still extend below the lid top 202 in order to engage with a corresponding material handling device 10 upon which lid 200 is placed.

The second arm 226 may extend through the latch opening 210 terminating above the upper surface 208. Optionally, the second arm 226 may terminate with a graspable surface 228 accessible from above the upper surface of the lid 200. The graspable surface 228 may also extend through the latch opening 210 to be more easily accessible to a user. The resilient latch 220 may deform along the bent edge 224 upon an application of force applied to the graspable surface 228 thereby displacing at least the second arm 226. The displacement of the second arm 226 may be in a direction consistent with the direction of the force applied. Preferably, each tang 230 may be located between the bent edge 224 and the graspable surface 228. Each latch edge 230 may further extend outwards from the second arm 226.

Each latch opening 210 may include a pair of opposite ends 211. The first arm 222 may be coupled to the lid top 202 proximate a first of the opposite ends 211, and the flange 218 may be coupled to the lid top 202 proximate a second of the opposite ends.

In one implementation, the first arm 222 may be integrally-molded with the lid top 202, the second arm 226 may be integrally molded with the first arm 222, and the lid top 202 and the first 222 and second 226 arms together may comprise a unitary construction.

Optionally, the lid top 202 may include a rim 206 extending around a circumference thereof, the rim and the first arm 222 being configured to capture a side of a material handling device 10 therebetween.

Figure 13:
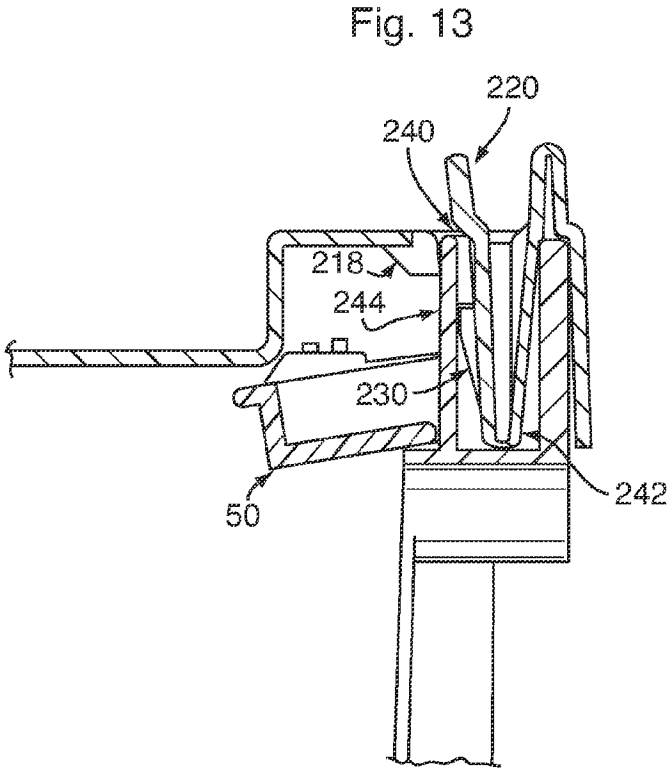
FIG. 13 is a partial side elevation view of the lid and material handling device of FIG. 12 showing the lid latch member latched with the material handling device.
Figure 12:
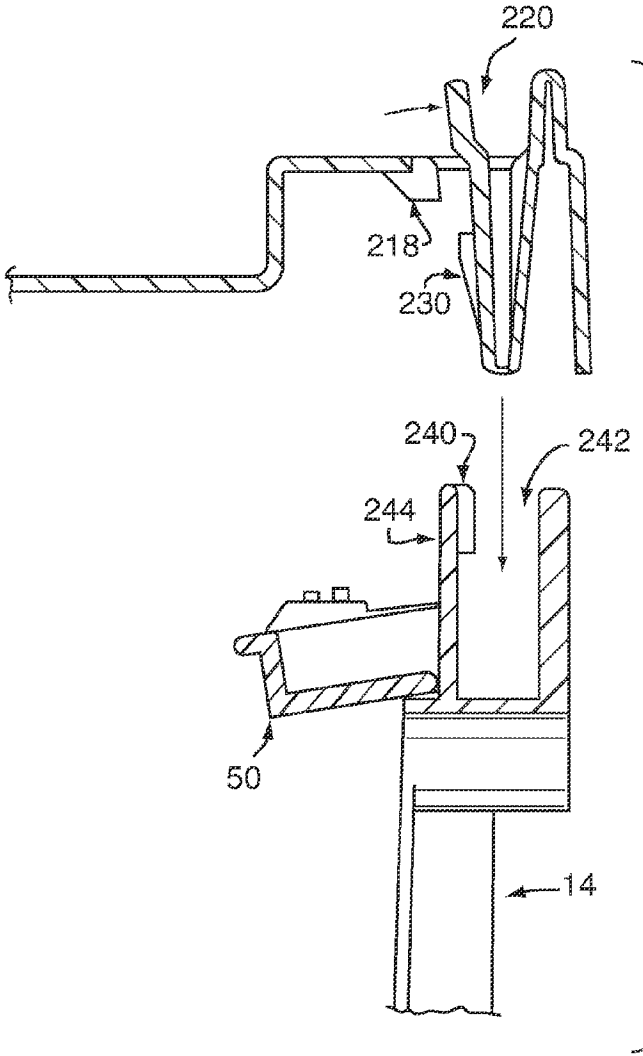
FIG. 12 is a partial side elevation view of the lid and lid latch member of FIG. 11 being inserted into the material handling device.

A material handling device assembly may comprise a material handling device 10 together with a material handling device lid 200 configured to enclose the device interior 12 of material handling device 10. Preferably the material handling device lid 200 may be used to cover a material handling device 10 and latch thereto by co-operation of each resilient latch 220 with suitable structural features of material handling device 10. As shown in FIGS. 12 and 13, material handling device 10 may therefore include at least one latch-receiving lip 240 formed at a respective interior portion of end wall 30 of side 14 for releasably latched engagement with the at least one tang 230 of one of the latch members 220. In another implementation, the lip 240 may be mounted to an upper surface of a latch wall 244 as shown in FIG. 12, the lip 240 facing the end wall 30, thereby forming a latch-receiving channel 242. This latching between lid 200 and material handling device 10 where each latch 220 latches to an interior latch wall 244 may be described as a reverse latching arrangement. This design may allow sufficient travel to the latching mechanism of lid 200 to allow low force to unlatch. The latching reverse hooking arrangement may allow each latch 220 to move when the device 10 is dropped but not release the lid 200 from device 10. Even where material handling device 10 is dropped on a corner of side 14 and base 20, the reverse locking latch mechanism may retain the lid 200 on material handling device 10, and may further engage the lid 200 with greater latching force when device 10 is dropped than when remaining stationary. As material handling devices 10 may be dropped, thrown, or mishandled frequently, it is desirable for lid 200 to remain latched to material handling device 10 while remaining easy to disengage latch 220 from latch wall 244 by a slight user-applied gripping force upon latch 220.

The lip 240 may be one continuous lip or split into a plurality of smaller lips, each one engaging a tang 230 of resilient latch 220. In a preferred implementation, there may be two latch-receiving lips 240, each disposed at the latch wall 244 shown in FIG. 8 aligned to receive tangs 230 of the implementation of resilient latch 220 shown in FIG. 11. Optionally, there may be an upright divider wall (not shown) formed near the middle of the latch-receiving channel 242 aligned to insert within a guide channel 232 of resilient latch 220, shown in FIG. 11, to aid guide the resilient latch 220 to a latching position within the material handling device 10. Optionally, each support member 50 may further comprise a longitudinal recess shaped to receive latch wall 244 therein when support member 50 is in the nesting position, thereby allowing support member 50 to rest close to side 14 when nesting material handling devices.

The material handling device lid 200 may include at least one air hole (not shown) to permit air circulation within the material handling device 10 when covered by material handling device lid 200. The air hole may be formed into lid top 202 and may be preferably clear of obstruction from any structural feature of material handling device 10 thereby allowing air to pass therethrough. The air hole may proximate an end 204 and is preferably not covered by a material handling device 10 when stacked upon lid 200. Each lid air hole may be further aligned with a corresponding air hole (not shown) formed into support member 50 or with a corresponding air hole (not shown) formed into a top edge of nesting support surface 42. In addition to allowing air to pass therethrough each air hole described herein may further be used to drain liquid at the air holes, such as rain water, or any liquid spilled upon lid 200 or material handling device 10.

Figure 1:
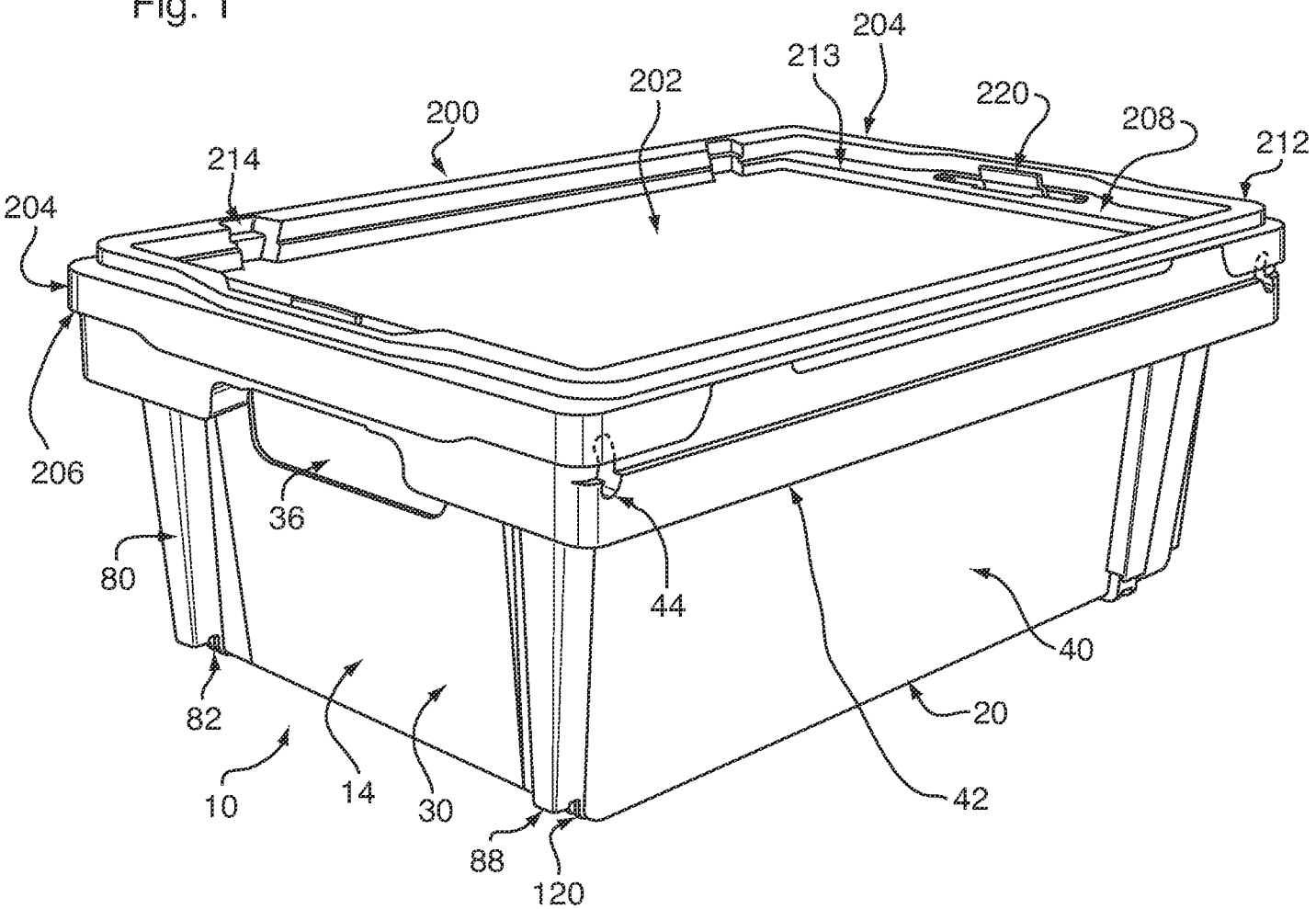
FIG. 1 is an exterior perspective view of the material handling device with lid.

The lid top 202 of lid 200 may comprise a raised surface 213 of upper surface 208 formed proximate each end 204. Raised surface 213 may be sloped upwards or downwards towards upper surface 208 for engaging outwardly-extending ribs 80 of a material handling device 10. Lid top 202 may further include a lid bumper 212, raised higher than upper surface 208, and substantially circumscribing lid top 202 as shown in FIG. 1. These features of shape may permit the base 20 of a material handling device 10 stacked upon lid 200 to sit upon lid top 202 such that lower portions of end walls 30 abut raised surface 213, and lower portions of end wall outwardly-extending ribs 80 rest upon raised surface 213 and abut lid bumper 212 thereby limiting movement of material handling device 10 towards ends 204. Likewise, lid bumper 212 may include lid bumper support recesses 214 aligned to receive portions of side wall exterior grooves 110 thereby abutting lid bumper 212 and limiting movement of material handling device 10 towards side walls 40.

Optionally, as shown in FIG. 5, stacking platform bumpers 122 of stacking platform 70 may serve to prevent latching of material handling device lid 200 to material handling device 10 when support member 50 is in the nesting position, as shown in FIG. 5, thereby orienting bumpers 122 towards lid 200. Support member 50 may also include a longitudinal latch recess bumper 216, shown in FIG. 14, which may also prevent resilient latch 220 from fully inserting into latch receiving channel 242 to allow tangs 230 to engage latch-receiving lips 240. Therefore, in one implementation, support members 50 must be rotated to their stacking positions before latching of lid 200 to material handling device 10 may be possible. Flange 218 of lid 200 may also abut against support member 50 when support member 50 is in the nesting position, thereby preventing latching of lid 200 to material handling device 10 when the support member 50 is in the nesting position. Rim 206 as shown in FIG. 1 may be shaped to extend downwards from lid top 202 at least at ends 204 to cover portions of flanged nesting support surface 42 of material handling device 10.

While the figures show material handling device lid 200 where structural features are of particular relative dimensions, these relative dimension are not intended to be a limiting feature of material handling device lid 200. While the structural elements of lid 200 are shown as being solid, substantially continuous pieces of material, other configurations may be possible. For example, all or portions of lid 200 may comprise cutouts of various shapes, or be constructed out of a resilient plastic, metal, carbon fiber or other material which may form meshed or webbed surfaces. Where any structural connection is shown as being orthogonal in the figures, these connections may be of any angle that may serve to form a material handling device 10 and material handling device lid 200. The material handling device lid 200 may be of unitary construction or formed of component parts. Optionally, the entire material handling device lid 200 may be of unitary construction save for the resilient latch 220.

In operation, material handling device 10 may be used for many different applications including by a mail service to store, sort, and handle mail, by a courier service to store items sent by courier, or by any other person or business to store documents, files, or any other objects that fit within the material handling device 10. The material handling device 10 is preferably used to store, sort, or handle material for mail operations, but the device 10 may also be used as a storage container for other purposes. In particular, the material handling device 10 may be used to store mail, including envelopes, packages, or other documents placed therein. Material handling device 10 may be used in a mail-sorting facility where it may be desirous to designate one end wall 30 of side 14 as a front end. For example, material handling device 10 may then be placed on a conveyor or manual rolling surface in a mail sorting facility such that the material handling device 10 may travel along in the direction of the front end. Alternatively, material handling device 10 may be placed in a mail delivery or transport vehicle such that the front end of each material handling device 10 is oriented in a uniform direction. Various means may be used to indicate which end wall 30 of material handling device 10 is the front end. Arrows may be formed into surfaces of the material handling device 10, including anywhere on side 14 or on a top edge of the flanged nesting surface 42 to indicate the preferred orientation of the material handling device 10. Furthermore, support member 50 located at the front end may by dyed or marked in a different color than the opposing support member 50. For example, the support member 50 at the front end may be colored white while the opposed support member 50 may be colored naturally or in a similar fashion as the rest of the material handling device 10, preferably gray.

Each material handling device 10 may also feature a card slot (not shown) for retaining an identification card at the front end. The card may by inserted into the card slot and removed from the card slot by sliding the card transversely therein. A finger-sized hole may be formed in the material handling device 10 at the front end just behind the card slot to allow an end-user to push out the card by hand when desired, making the card easier to grab and slide out of the card slot.

The material handling device 10 may be sized and shaped to fit within a standard-sized drawer in a post office or other courier or postal facility. Matching the material handling device 10 size with a drawer size may allow the device 10 to be ergonomically inserted into or removed from the drawer for transport, filling, or emptying. The handle apertures 36 formed in end walls 30 may also be ergonomically shaped to allow material handling device 10 to be grasped and lifted from the handles without discomfort. This may be achieved by aligning the top edge of handle aperture 36 with the bottom edge of nestable surface 42. Since the nestable surface extends outwardly from the side 14 as shown in FIG. 1, the graspable region formed by handle aperture 36 and nestable surface 42 may be of sufficient dimensions to be held ergonomically, making the material handling device 10 easy to hold, lift, or grip. Preferably, to maintain ergonomic capabilities of the material handling device 10, without overfilling material handling device 10, it may be beneficial to limit the overall size of the material handling device such that when filled with standard-sized mail or packages, the total weight of the material handling device 10, lid 200 and contents does not exceed about 8 kg. A total weight of greater than about 8 kg may increase the difficulty in lifting or transporting material handling device 10 such that any ergonomic features of material handling device 10 may be insufficient in mitigating risk of injury when handling material handling device 10. In addition, by limiting the size and weight of the material handling device 10, mail sorting, storing, and handling efficiency may be increased as each material handling device 10 may be more likely to be filled at or near full capacity than larger heavier containers.

The design of material handling device 10 may allow a user to lift and pull the material handling device 10 towards the user without having to lift or engage the weight of the material handling device 10. The material handling device 10 may be lifted at one handle aperture 36 and slid along a surface upon curved bumps 120 or on other exterior structural features of material handling device 10. Where multiple material handling device 10 are stacked, the bottom stacked device 10 may be lifted and dragged in this manner to drag all of the material handling devices 10 stacked thereupon without having to lift or engage the weight of all stacked material handling devices 10. Where it is desired to remove a material handling device 10 from a stack of material handling devices 10, a middle or top material handling device 10 may be lifted and dragged off of a lower stacked material handling device 10 in a similar fashion, allowing the dragged material handling device 10, and any material handling device 10 stacked thereupon, to fall to the ground upon clearing the lower stacked material handling device 10 without requiring the user to engage the entire weight of any of the material handling devices 10.

Drain holes (not shown) may be formed at bottom exterior portions of nesting channels 84 to allow any water or liquid that comes in contact with the nesting channels 84 either by natural precipitation or other means to drain out of material handling device 10.

Either or both of the material handling device 10 and the lid 200 may be made of a recyclable material. No disassembly of material handling device 10 or lid 200 may be required prior to recycling. While the material handling device 10 may comprise structural features that allow for stacking with like material handling devices 10 only in one material handling device 10 orientation, the lid 200 may be mounted bi-directionally to material handling device 10. Due to the structural features previously described herein, the material handling device 10 may remain stable when stacked with a material handling device 10 of like construction either with or without a lid 200 secured to material handling device 10.

As previously described, divider walls 90 may serve to maintain a sorting or stacking arrangement of items placed within the material handling device 10. Where the material handling device 10 is less than full, the divider walls 90 may be used in this way to maintain the sorting or stacking integrity of mail placed within the material handling device 10.

Floor markings may be indicated at the bottom of material handling device 10 to show fill levels and also act as anchor points for a mail sequence retention device.

Although the invention is described in terms of particular implementations, it is to be understood that the invention is not limited in its application to the details of construction and to the arrangements of the components set forth in the description or illustrated in the drawings. The invention is capable of other embodiments and of being practiced and carried out in various ways without departing from the scope of the invention.

What is claimed is:

1. A material handling device comprising:

a base;

a side extending from the base, the base and the side defining a device interior;

a support member disposed within the device interior proximate the side, the support member including a cam and being rotatable between a material handling device stacking position and a material handling device nesting position; and a resilient biasing member coupled to the side and being configured to engage the cam and thereby urge the support member into one of the stacking and nesting positions, the resilient biasing member being further configured to effect a translation of the support member towards the side as the support member rotates from a position intermediate the stacking and nesting positions to the one of the stacking position and nesting positions.

2. The material handling device of claim 1, wherein the resilient biasing member has a neutral position and a deformed position displaced from the neutral position, the cam includes a cam surface configured to direct the biasing member from the neutral position towards the deformed position upon the rotation of the support member between the one of the stacking and nesting positions and the intermediate position, and the biasing member is configured to urge the support member from the intermediate position into the one of the stacking and nesting positions as the biasing member returns to the neutral position from the deformed position.

3. The material handling device of claim 2, wherein the resilient biasing member includes a hook member that is configured to engage the cam surface and thereby maintain the support member within the device interior as the support member rotates between the stacking position and the nesting position.

4. The material handling device of claim 2, wherein the side includes a guide channel, and the support member comprises a guide pin extending axially from an end thereof into the guide channel for sliding engagement therewith, the guide channel being configured to facilitate the translation of the support member towards the side as the support member rotates from the intermediate position towards one of the stacking and nesting positions.

5. The material handling device of claim 4, wherein the guide channel is further configured to direct the guide pin towards the base and thereby maintain the support member within the device interior as the support member rotates between the stacking position and the nesting position.

6. The material handling device of claim 4, wherein the guide channel is substantially arcuately-shaped and comprises a first end and a second end, the first end being disposed above the second end, and the guide pin is disposed to engage the first end of the guide channel when the support member is in the stacking position and to engage the second end when the support member is in the nesting position.

7. The material handling device of claim 1, wherein the support member further comprises a stacking platform that includes a pair of the ribs configured to capture therebetween a foot portion of a material handling device stacked on the material handling device to thereby limit lateral movement of the stacked material handling device relative to the material handling device when the support member is in the stacking position.

8. The material handling device of claim 7, wherein the stacking platform further includes a stabilization channel section for capturing therein an outwardly-extending rib of the stacked material handling device to further limit lateral movement of the stacked material handling device relative to the material handling device when the support member is in the stacking position.

9. The material handling device of claim 7, wherein the stacking platform further includes at least one stacking platform bumper positioned to support a portion of the stacked material handling device.

10. The material handling device of claim 7, wherein the stacking platform further includes a nesting channel section for capturing therein an outwardly-extending rib of a material handling device nested in the material handling device to thereby limit lateral movement of the nested material handling device relative to the material handling device when the support member is in the nesting position.

11. The material handling device of claim 10, wherein the side includes a nesting channel formed in an interior surface thereof, the nesting channel being substantially continuous with the nesting channel section when the support member is in the nesting position and is configured to capture the outwardly-extending rib therein.

12. The material handling device of claim 1, wherein the side comprises a shoulder disposed in the device interior for supporting the support member in the stacking position.

13. The material handling device of claim 1, wherein the support member further comprises a biasing channel formed therein for receiving the biasing member therein, and a portion of the cam extends across the biasing channel.

14. A material handling device lid comprising:

a lid top including an upper surface, a lower surface, a latch opening extending between the upper and lower surfaces, and a flange coupled to the lower surface; and a resilient latch coupled to the lid top, the resilient latch being configured as a V-spring and comprising a first arm and a second arm, the first arm being coupled to the lid top and extending below the lid top away from the lower surface, and a second arm coupled to the first arm and extending towards the lid top and the lower surface, the second arm including at least one tang disposed proximate the flange and below the lower surface, wherein the second arm extends through the latch opening and terminates above the upper surface.

15. The material handling device lid of claim 14, wherein the latch opening includes a pair of opposite ends, the first arm is coupled to the lid top proximate a first of the opposite ends, and the flange is coupled to the lid top proximate a second of the opposite ends.

16. The material handling device lid of claim 15, wherein the first arm is integrally-molded with the lid top, the second arm is integrally-molded with the first arm, and the lid top and the first and second arms together comprise a unitary construction.

17. The material handling device lid of claim 16, wherein the lid top includes a rim extending around a circumference thereof, the rim and the first arm being configured to capture a side wall of a material handling device therebetween.

18. A material handling device assembly comprising:

a material handling device comprising:

a base;

a side extending from the base, the base and the side defining a device interior;

a support member disposed within the device interior proximate the side, the support member including a cam and being rotatable between a material handling device stacking position and a material handling device nesting position; and a resilient biasing member coupled to the side and being configured to engage the cam and thereby urge the support member into one of the stacking and nesting positions, the resilient biasing member being further configured to effect a translation of the support member towards the side as the support member rotates from a position intermediate the stacking and nesting positions to the one of the stacking position and nesting positions; and a material handling device lid configured to enclose the device interior, the material handling device lid comprising:

a lid top including an upper surface, a lower surface, a latch opening extending between the upper and lower surfaces, and a flange coupled to the lower surface; and a resilient latch coupled to the lid top, the resilient latch being configured as a V-spring and comprising a first arm and a second arm, the first arm being coupled to the lid top and extending below the lid top away from the lower surface, and a second arm coupled to the first arm and extending towards the lid top and the lower surface, the second arm including at least one tang disposed proximate the flange and below the lower surface.

* * * * *